US006053827A

United States Patent [19]

MacKay, Jr. et al.

[11] Patent Number: 6,053,827

[45] **Date of Patent: *Apr. 25, 2000**

[54] METAL BAT WITH PRESSURIZED BLADDER IN HITTING ZONE AND METHOD OF MAKING SAME

[75] Inventors: Jack W. MacKay, Jr.; Kaye K. MacKay; Jack W. MacKay, III, all of Mt. Pleasant, Tex.

[73] Assignee: Hillerich & Bradsby Co., Louisville, Ky.

[ * ] Notice: This patent is subject to a terminal disclaimer.

[21] Appl. No.: 08/802,516

[22] Filed: Feb. 20, 1997

[51] Int. Cl.[7] ..... A63B 59/06

[52] U.S. Cl. ..... 473/566

[58] Field of Search ..... 473/564–568

[56] References Cited

U.S. PATENT DOCUMENTS

| | | | |
|---|---|---|---|
| Re. 31,811 | 1/1985 | Foreman | 273/72 A |
| 1,831,255 | 11/1931 | Menzies . | |
| 2,227,817 | 1/1941 | Allen | 29/148.2 |
| 3,233,727 | 2/1966 | Wilson | 206/46 |
| 3,479,030 | 11/1969 | Merola | 273/72 |
| 3,817,522 | 6/1974 | Simmons | 273/78 |
| 3,963,239 | 6/1976 | Fujii | 273/72 A |
| 4,682,773 | 7/1987 | Pomilia | 273/26 B |
| 4,744,136 | 5/1988 | Foreman et al. | 29/451 |
| 5,114,144 | 5/1992 | Baum | 273/72 R |
| 5,150,897 | 9/1992 | Wortman . | |
| 5,316,300 | 5/1994 | Simmons | 273/80 R |
| 5,364,095 | 11/1994 | Easton et al. | 273/72 A |
| 5,393,055 | 2/1995 | MacKay, Jr. | 273/72 A |
| 5,415,398 | 5/1995 | Eggiman | 273/72 A |
| 5,421,572 | 6/1995 | MacKay, Jr. | 273/72 A |
| 5,458,330 | 10/1995 | Baum | 273/72 R |
| 5,460,369 | 10/1995 | Baum | 273/72 R |
| 5,494,280 | 2/1996 | MacKay, Jr. | 273/72 A |
| 5,511,777 | 4/1996 | McNeely | 273/72 A |
| 5,533,723 | 7/1996 | Baum | 372/72 R |
| 5,607,364 | 3/1997 | Hedrick et al. | 473/318 |
| 5,632,693 | 5/1997 | Painter | 473/318 |

FOREIGN PATENT DOCUMENTS

| | | |
|---|---|---|
| 124401 | 6/1947 | Australia . |
| 189442 | 8/1992 | Taiwan . |
| 195820 | 12/1992 | Taiwan . |
| 2 247 932 | 3/1992 | United Kingdom . |

OTHER PUBLICATIONS

Japanese Kodai No. 52–37126, Tanigawa.

Page from 1993 catalogue of a Japanese bat manufacturer known as SSK.

*Primary Examiner*—Mark S. Graham

*Attorney, Agent, or Firm*—James C. Eaves, Jr.; Greenebaum Doll & McDonald PLLC

[57] ABSTRACT

A tubular metal ball bat includes a tubular barrel having a hitting zone and an end cap at a distal end thereof, a handle at a proximal end thereof and a pressurized bladder positioned in the bat barrel and in the area of the hitting zone. A method is also disclosed for inserting and anchoring the pressurized bladder in the hitting zone. A variety of pressurized bladder configurations are disclosed with valves for pressurizing the bladders in the bat barrel. The bladder can include one or more separate bladders or compartments which are designed to occupy a predetermined length of the hitting zone.

13 Claims, 10 Drawing Sheets

METAL BAT WITH PRESSURIZED BLADDER IN HITTING ZONE AND METHOD OF MAKING SAME

BACKGROUND OF THE INVENTION

1. Field of the Invention

This invention relates to a tubular metal ball bat, such as a baseball bat or a softball bat, which includes a tubular barrel having a hitting zone and an end cap at the distal end, a handle at the proximal end and a pressurized bladder inserted into the tubular barrel in the area of the hitting zone. This invention also relates to the method of inserting and anchoring the pressurized bladder in the hitting zone.

2. Description of the Prior Art

Hollow metal bats of aluminum or similar material have been developed and have been in use for many years when playing baseball, softball and the like. Improvements and developments have been made in the construction of hollow metal bats since their introduction. Such improvements and developments are disclosed in earlier U.S. Pat. Nos. 5,393,055, 5,421,572 and 5,494,280. In addition, the distal end of such bats has traditionally been reinforced by various closure caps and constructions. Efforts have also been made to cushion and reinforce the bat by completely filling the interior of the bat with a polyurethene foam material as disclosed in U.S. Pat. No. 4,682,773. Additionally, efforts have been made to improve the characteristics of a metal bat by introducing air under pressure into the entire interior of a hollow metal bat as disclosed in U.S. Pat. No. RE 31,811. The following U.S. patents also illustrate various developments relating to this field of endeavor:

| | | |
|---|---|---|
| 1,831,255 | 3,479,030 | 5,364,095 |
| 2,227,817 | 3,963,239 | 5,415,398 |
| 3,233,727 | 4,744,136 | 5,511,777 |

The foregoing patents disclose bats filled with foam to increase the strength of the bat as well as bats of hollow metal construction or other hollow metal devices that have been otherwise modified in order to improve their operational characteristics. However, the prior art does not disclose the concept of including a pressurized bladder or bladders in the area of the hitting zone of a hollow metal bat with the bladder or bladders being accurately positioned and retained in place in the hitting zone area.

SUMMARY OF THE INVENTION

In accordance with the present invention, an inflatable bladder is inserted into an open distal end of a tubular metal ball bat and positioned in the bat barrel in the area of the hitting zone. Preferably, the bladder is made of a flexible resilient material, is cylindrical in shape and has an outer diameter which is approximately the same as the inside diameter of the bat barrel. However, depending on the application, the diameter of the bladder can be smaller than the inside diameter of the bat barrel, or even larger. In its preferred form, the bladder extends substantially the full length of the hitting zone from the transition zone to the distal end. However, the bladder can extend varying lengths. The bladder is preferably a single bladder, but can comprise two or more bladders laid end-to-end, or separate bladder compartments, inserted into the tubular bat barrel.

The bladder is preferably constructed so that edges of the flexible resilient material forming the bladder in the uninflated condition engage the interior wall of the bat barrel in order to assist in positioning the uninflated bladder in the bat barrel. Once fully inflated in the bat barrel, the side wall of the bladder frictionally engages the inside surface of the bat barrel and serves to fix the bladder in place. Alternatively, the end of the transition zone adjacent the hitting zone, or the proximal end of the hitting zone, can be stiffened or closed off with a transverse wall, such as disclosed in copending application, Ser. No. 08/791,464, filed Jan. 27, 1997, Pat. No. 5,964,673 in order to position the proximal end of the bladder in the bat barrel. In another embodiment, the proximal end of a single bladder, or proximal end of the innermost bladder if more than one bladder is used, can be tapered in order to engage the interior wall of the bat barrel in the transition zone as it tapers down from the generally straight hitting zone.

Once in position inside the tubular bat barrel in the area of the hitting zone, the inflatable bladders of the present invention are inflated or pressurized. Upon inflation, the cylindrical wall of the bladder is pressurized outwardly, and its exterior surface exerts increasing pressure on the interior of the bat barrel in the hitting zone. When the cylindrical wall of the bladder is pressurized against the interior of the wall of the hitting zone, the wall of the hitting zone becomes supported by the bladder. This interaction of the pressurized bladder against the inside of the bat barrel produces a number of beneficial characteristics in a metal bat, not the least of which are regulation and equalization in the trampoline effect of the hitting zone wall, almost complete reduction in the vibration transmitted to the bat handle upon ball impact, significant improvement in the bat sound upon ball impact, and added durability and length of bat life.

Once the bladder or bladders have been inflated or pressurized inside the bat barrel or otherwise forced into the bat barrel after being pressurized, a suitable end cap is fitted into the open distal end of the bat barrel. The distal end of the single bladder or distal end of the outermost bladder if more than one bladder is used, can be configured to be locked in place upon fitting the end cap. Thus, if desired, the bladder or bladders can be locked into place longitudinally within the bat barrel at both the proximal and distal ends. Alternatively, the inflated bladder itself can serve to hold itself in position by reason of the frictional engagement of the outside of the cylindrical wall with the inside of the bat barrel wall, especially where the proximal end of the bladder is tapered to match the taper of the bat barrel transition zone.

It has been found in accordance with the present invention that the level of pressurization of the bladder and, hence, the pressure on the interior of the hitting zone wall permits modification and design of the trampoline effect for the hitting zone. Further, the inclusion of a pressured bladder enables the bat barrel wall in the area of the hitting zone to be constructed of less thickness, thereby increasing the capability of the hitting zone wall to deform upon impact. The pressurized bladder inside the hitting zone wall then provides the necessary resiliency in assisting the wall of the hitting zone to return to its original configuration. As such, the trampoline effect of the hitting zone of the bat barrel can be increased or otherwise modified to the specified design characteristics desired for the bat.

In addition, it has further been found that reducing the thickness of the hitting zone bat barrel wall, as much as approximately 0.005–0.030 inches in reduced thickness, can result in a significant reduction in the overall weight of the hitting zone of the bat, if the weight added by the bladder is less than the weight of the removed barrel metal over the distance of the hitting zone. This reduction of the bat hitting zone weight enables the bat speed to be increased when a batter swings the bat, which results in greater ball exit velocity and greater ball distance when the bat strikes the ball.

Still further, it has been found that a metal bat with a pressurized bladder or bladders in the bat barrel hitting zone in accordance with the present invention has improved vibration characteristics and sound effects when the bat impacts a batted ball. More specifically, it has been found that the installation of a pressurized bladder into the tubular bat barrel of a metal bat in the area of the hitting zone substantially reduces or dampens the vibrations which are otherwise transmitted to the bat handle upon ball impact. Further, the sound characteristics of a metal bat constructed in accordance with the present invention are more like the sound effect of a wood bat, thus significantly improving the aesthetic characteristics of the metal bat. In particular, the bladder reduces the high bat ring normally encountered with metal bats, thus making bats built in accordance with the present invention have a more comfortable sound level for both players and spectators.

Therefore, it is an object of the present invention to provide a hollow metal ball bat having a tubular barrel defining a hitting zone at the distal end in which the interior of the bat barrel is provided in the area of the hitting zone with an inflated or pressurized bladder which exerts an outward force on the interior of the tubular bat wall of the hitting zone to improve the trampoline effect of the hitting zone.

Another object of the present invention is to provide a hollow metal bat in accordance with the preceding object in which the pressurized bladder enables the hitting zone wall of the barrel to be constructed of less thickness thereby increasing the capability of the hitting zone wall to deform with the pressurized bladder and assists in returning the wall of the hitting zone to its original configuration thus allowing for regulation and equalization of the trampoline effect of the hitting zone, and allowing a manufacturer to tailor the trampoline effect of a metal bat.

A further object of this invention is to provide a hollow metal bat in accordance with the preceding objects in which the capability of reducing the thickness of the wall of the hitting zone reduces the weight of the hitting zone of the bat thereby enabling the bat speed to be increased when a batter swings the bat, which increased bat speed results in higher exit velocity for the ball and greater distance of ball travel when the bat strikes the ball.

A still further object of the present invention is to provide a hollow metal ball bat having one or more pressurized bladders inserted into the hollow bat in the area of the hitting zone, in which the bladder or bladders preferably include a resilient, flexible wall which will expand into engagement with the interior of the wall of the hitting zone in order to place the wall of the hitting zone under outward pressure for increasing the trampoline effect of the wall of the hitting zone and enabling the thickness of the wall of the hitting zone to be reduced to a minimum weight thereby enhancing the capability of a batter to swing the bat with increased bat speed.

Yet another object of the present invention is to provide a hollow metal ball bat with one or more pressurized bladders included in the area of the hitting zone in which the bladder or bladders create improved vibration dampening characteristics and improved sound effects for the bat when the bat impacts a ball, thus improving the vibration and sound characteristics of the metal bat by lowering both the vibration and sound levels upon impact.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
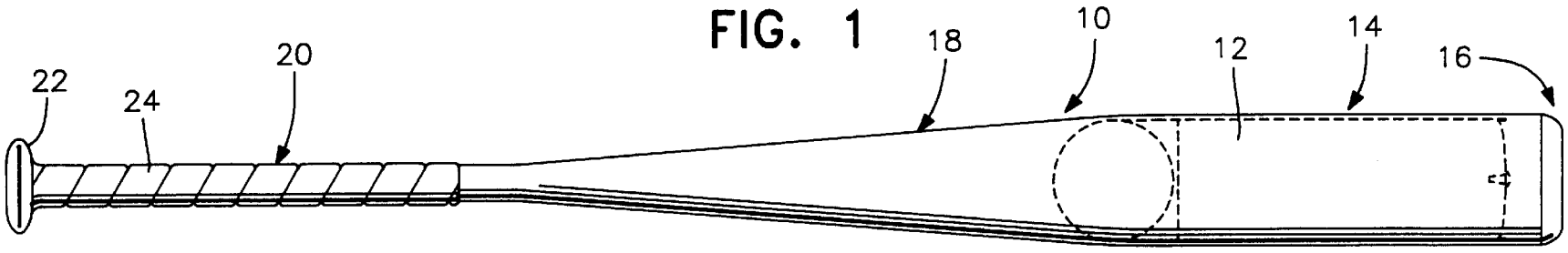
FIG. 1 is a side elevational view of one embodiment of a hollow metal bat in accordance with the present invention, with a single pressurized bladder inserted into the bat barrel in the area of the hitting zone.

In describing the preferred embodiments of the present invention as illustrated in the drawings, specific terminology will be resorted to for the sake of clarity. However, the invention is not intended to be limited to the specific embodiments illustrated and terms so selected; it being understood that each specific term includes all technical equivalents which operate in a similar manner to accomplish a similar purpose.

Referring to the embodiment illustrated in FIGS. 1–4 of the drawings, the hollow metal bat is generally designated by reference numeral 10 and includes a hollow barrel 12 extending throughout the length thereof. The barrel 12 includes a hitting zone generally designated by reference numeral 14 at the distal end thereof that is provided with an end cap 16 forming a closure for the distal end. The bat barrel 12 also includes a tapered transition zone 18 extending from the proximal end of the hitting zone 14 to a handle generally designated by reference numeral 20. The handle 20 includes a closure knob 22 at the proximal end thereof and grip enhancing material 24 extending substantially along the entire length of the handle in a known manner to facilitate gripping of the bat by a person utilizing the bat to swing in a manner to strike a baseball, softball or the like.

The hitting zone 14 is formed by a generally cylindrical peripheral wall 26. The hitting zone wall 26 preferably has substantially the same thickness and diameter throughout the length of the hitting zone. Positioned within the hitting zone 14 is a tubular bladder 28. The bladder 28 includes a generally cylindrical peripheral wall 30 of a resilient flexible material, or a semi-rigid material, having a diameter approximating the internal diameter of peripheral wall 26 for surface-to-surface contact with the interior surface 27 of the wall 26. The bottom or proximal end of the bladder 28 has an end wall 32, and the top or distal end has an opposite end wall 34. The ends 32 and 34 of the bladder may be flat and hence perpendicular to the cylindrical wall 30. The end walls are also unitary with the peripheral wall as by integral molding or sealing, and end wall 34 is provided with a self sealing valve 36 which enables an inflating needle (not shown) to be inserted into a passageway in the valve which seals itself when the needle is removed in a well known manner. Alternatively, the distal end of the bladder may be provided with an outwardly projecting valve such as used on an inflatable inner tube in a pneumatic tire or any other available self-sealing valve mechanism.

Once in position in the bat barrel, the bladder 28 is inflated or pressurized through the self-sealing valve 36 in the distal end of the bladder prior to insertion of the end cap 16. The pressurization of the bladder 28 causes the cylindrical peripheral wall 30 of the bladder to expand into engagement with the interior surface 27 of the bat wall 26, thus placing an outward force on the wall 26 of the hitting zone 14. This outward force supports the wall of the hitting zone and outwardly pressurizes the wall to thereby enable the wall of the hitting zone to be constructed with less thickness of metal and with less weight. The outward force exerted on the inner surface of the hitting zone also resists deformation of the wall when impacting a ball and more rapidly returns the wall to its original configuration when deformed upon impact with a ball, thereby increasing the trampoline effect of the wall of the hitting zone, which in turn increases the distance that a ball will travel when struck by the hitting zone of the bat. Also, the weight of the bladder 28 is designed to be less than the weight of the removed metal from the bat in the hitting zone. This reduction in weight of the hitting zone moves the center of gravity of the bat toward its proximal end, thus enabling the bat to be swung with a greater bat speed. The bladder can also be used to add weight to the bat, if additional weight is desired.

In accordance with the present invention, the thickness of the bat barrel wall 26 in the area of hitting zone 14 can be reduced on the order of 0.005–0.030 inches, and perhaps more, depending upon the original design thickness of the bat without a pressurized bladder. Further, the pressurization of the bladder 28 can be as little as near zero and as high as 60 psi, or even more if desired for special constructions. However, the pressurization should normally range between about 15 psi at the low end and about 50 psi at the high end and, preferably, between about 20 psi and about 30 psi.

After the bladder 28 has been inserted and inflated or pressurized to the desired internal pressure, the end cap 16 is inserted into the distal open end of the bat barrel 12. As illustrated in FIG. 4, the end cap 16 includes an end wall 50 having a sleeve or flange 56 telescoped into the interior of the distal end of the bat barrel 12. The barrel 12 includes a peripheral groove 52 receiving a peripheral rib 54 on the periphery of the sleeve 56 which structure is the same as disclosed in my previously discussed patents. The end wall 50 of the end cap 16 also preferably includes a peripheral edge 58 which extends into engagement over the end edge of the barrel 12, a concave recess 60 in the distal end thereof and radial reinforcing flanges 62 in the interior thereof. This end cap is the same as that disclosed in FIGS. 1–3 of copending application Ser. No. 06/396,225 filed Feb. 28, 1995. Further, the distal end of the peripheral wall 30 of the bladder 28 can be provided with a flange 64 which extends beyond the end wall 34 and is received between barrel wall 26 and peripheral flange 56 on end cap 16. Thus, end cap 16 positively positions the distal end of bladder 28 about the longitudinal axis of the bat by engaging cylindrical flange 64 between peripheral flange 56 and barrel wall 26.

Positioned at the proximal end of the hitting zone 14 is a transverse wall generally designated by reference numeral 63 which is preferably formed by a hardenable material 65 such as urethane or the like. The hardenable material is accurately positioned in the bat barrel 12 by first inserting a spherical sponge ball 66 or a similar sponge or foam product. The ball 66 has an external circumference slightly larger than the internal diameter of the hitting zone wall 26 so that when it is forced into the open distal end of the bat barrel 12, it will be retained in the position to which it is inserted by the tendency of the resilient sponge ball to return to its normal diameter or external circumference. Thus, the spherical ball 66 which has been deformed when inserted into the bat barrel will tend to expand and thus frictionally engage the interior surface 27 of the bat barrel 12 and remain in the position to which it is inserted. The hardenable material can then be poured into the open distal end of the bat barrel when in a generally vertical position and when in liquid state so that it flows downwardly to engage the spherical resilient ball 66 while it hardens and thus forms a barrier or wall 63. The transverse wall 63 can be formed by other structures, such as described in co-pending application, Ser. No. 08/791,464 filed Jan. 27, 1997 now Pat. No. 5,964,673.

Preferably, the bladder 28 completely fills the bat barrel 12 in the area of the hitting zone 14 with the peripheral wall 30 of the bladder 28 in intimate surface-to-surface contact throughout its length and periphery with the interior surface 27 of the wall 26 defining the hitting zone 14. The transverse wall 63 is designed to ensure proper orientation of the bladder 28 in the area of the hitting zone. Thus, the proximal end of the bladder 28 adjacent the wall 63 can preferably have sufficient rigidity to directly engage the transition zone at the proximal end of the hitting zone 14 thereby positioning the bladder in optimum relation to the hitting zone 14. Further, the wall 63 can also serve to isolate the hitting zone from the handle of the bat and reduce the transfer of vibrations from the hitting zone to the handle of the bat, all as described in the aforesaid copending patent application.

FIGS. 5–8 illustrate another embodiment of the present invention in which the bat has a longer hitting zone generally designated by reference numeral 70, such as may be used for a baseball bat, whereas the bat 10 illustrated in FIG. 1 has a shorter hitting zone, such as may be used in a softball bat. In the embodiment of the invention illustrated in FIGS. 5–8, the hitting zone 70 is defined by a peripheral wall 72 closed by an end cap 74 and provided with a pair of pressurized tubular bladders 76 in the bat barrel in the area of the hitting zone. Each of the bladders 76 is formed of a flexible resilient material, or a semi-rigid material, and includes a generally cylindrical peripheral wall 78 and an end wall 80. The two inserted bladders 76 are preferably oriented with their ends 80 abutting at 82 generally at the center of the hitting zone 14. Suitable inflation valves 82 to enable inflation of the bladders 76 are provided for sequential inflation and pressurization before the end cap 74 is placed in the distal end of wall 72, as described in connection with the embodiment illustrated in FIGS. 1–4. Transverse wall 86 is formed in the same manner as the transverse wall 63 as illustrated in FIG. 2.

Figure 8:
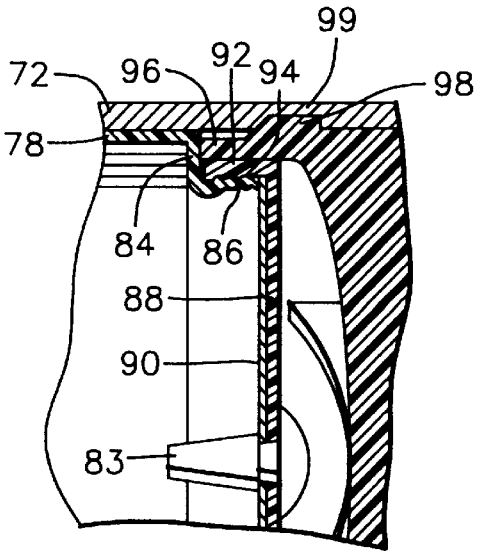
FIG. 8 is an enlarged fragmental sectional view illustrating the relationship of the end cap to the distal end of the pressurized bladder and bat barrel of the embodiment of the invention illustrated in FIG. 5.
Figure 7:
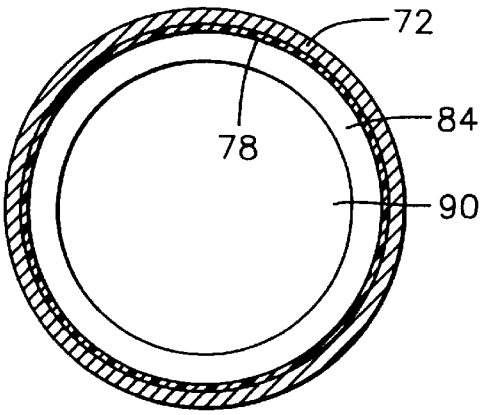
FIG. 7 is a transverse sectional view taken along section line 7—7 on FIG. 6, illustrating further structural details of the relationship between the pressurized bladders and the wall of the hitting zone.
Figure 5:
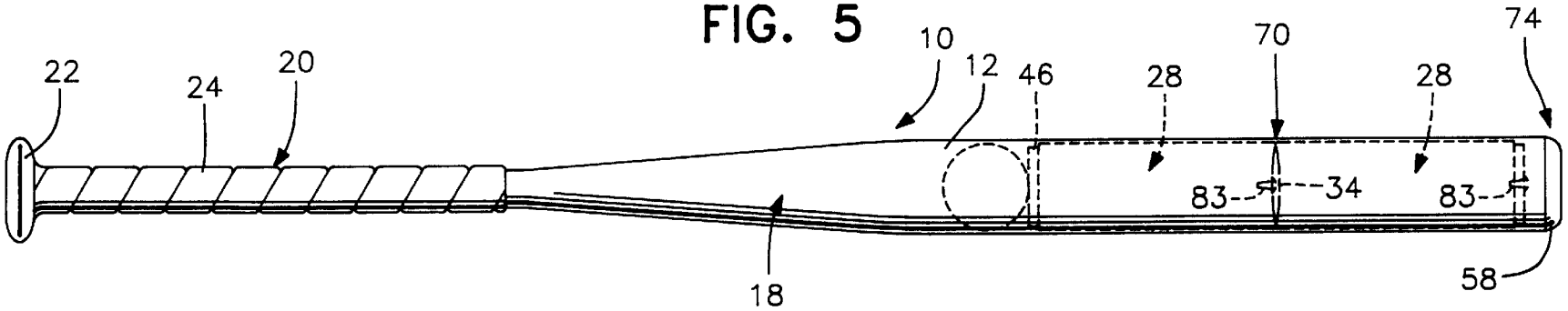
FIG. 5 is a side elevational view of another embodiment of a hollow metal bat in accordance with the present invention, with a pair of pressurized bladders inserted end-to-end in the bat barrel in the area of the hitting zone.
Figure 6:
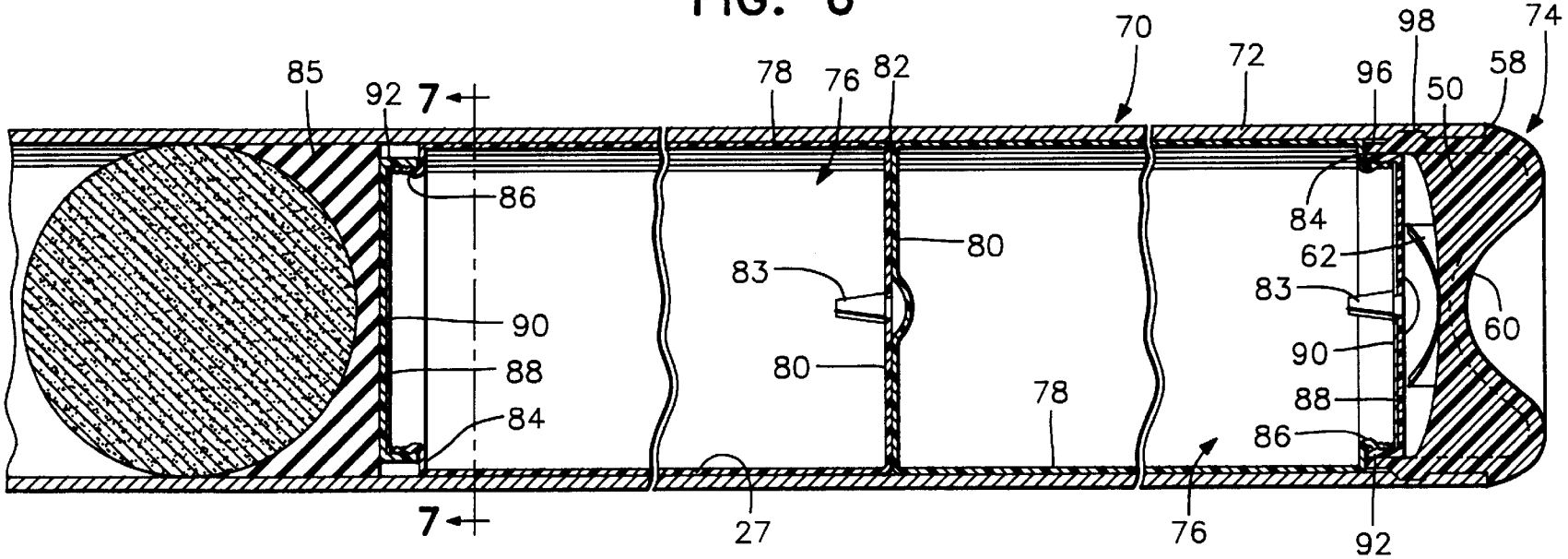
FIG. 6 is a longitudinal sectional view, on an enlarged scale, illustrating the structural details of the embodiment of the invention shown in FIG. 5.

The opposite end of each of the bladders 76, as illustrated in FIGS. 6 and 8, has the following configuration. Each opposite end is provided with a radially inwardly extending partial end wall 84 which then is formed into a smaller diameter neck 86, as illustrated in FIG. 8. A closure cap 88 forms a closure for the neck 86 and a seal 90 is positioned between the end of the neck 86 and the closure cap 88. The closure cap 88 includes a peripheral wall 92 which telescopes over the cylindrical neck 86, as illustrated in FIG. 8, with the internal surface of the cap wall 92 and the external surface of the neck 86 including peripheral ridges and grooves 94 in the form of threads by which the bladders or containers 76 can be effectively closed. The bladders 76 can be pressurized in sequence after each is inserted into the bat barrel or, if constructed of a semi-rigid material, they may be pressurized first and then inserted into the bat barrel to a desired point by overcoming the frictional contact between the bladders 76 and the inner surface of the bat barrel.

Figure 2:
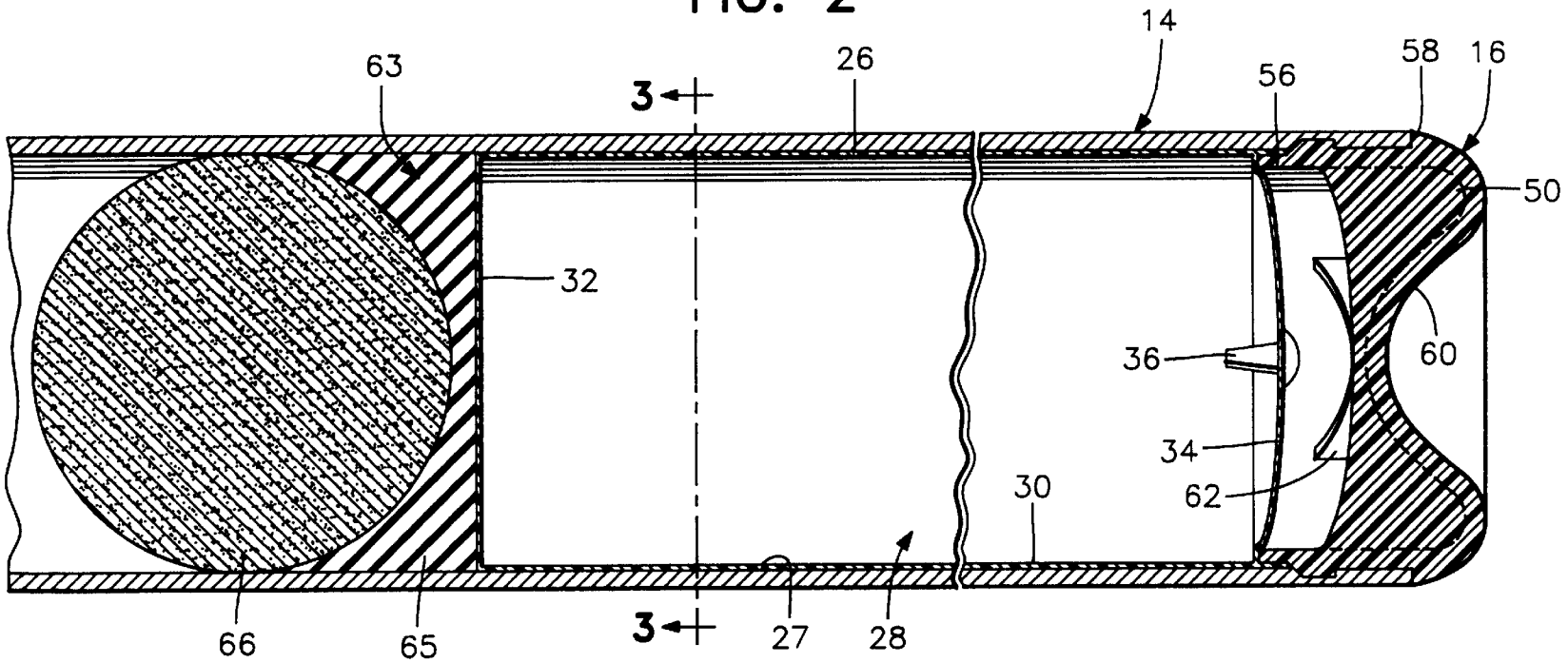
FIG. 2 is a longitudinal sectional view, on an enlarged scale, illustrating the interior construction of the hitting zone of the hollow metal bat in accordance with FIG. 1, in which the insertion of the pressurized bladder into the bat barrel is limited by a transverse wall structure defined by hardenable material that has first been poured into the end of the bat.

The end cap 74 is also of the same construction as the end cap 16 illustrated in FIGS. 2 and 4 and includes flange 96 which telescopes into the distal end of the bat barrel and forms a rigid connection with the peripheral wall 72. Ridge 98 on the end cap 74 fits into groove 99 on the inside of wall 72 in the same manner as in FIG. 4. The interior surface of the sleeve or flange 96 on the end cap preferably engages the exterior surface of the peripheral wall 92 of the cap 88. Thus, the peripheral flange 96 extends telescopically over the peripheral wall 92 of the end cap 88 to maintain these structures in a stable relationship. Meanwhile, the cap 88 of the inner bladder or container 76 engages the transverse wall 85 thus positioning the two bladders 76 in a desired optimum position within the hitting zone 70 with the end walls 80 being adjacent each other and the closure caps 88 being remote from each other.

Figure 9:
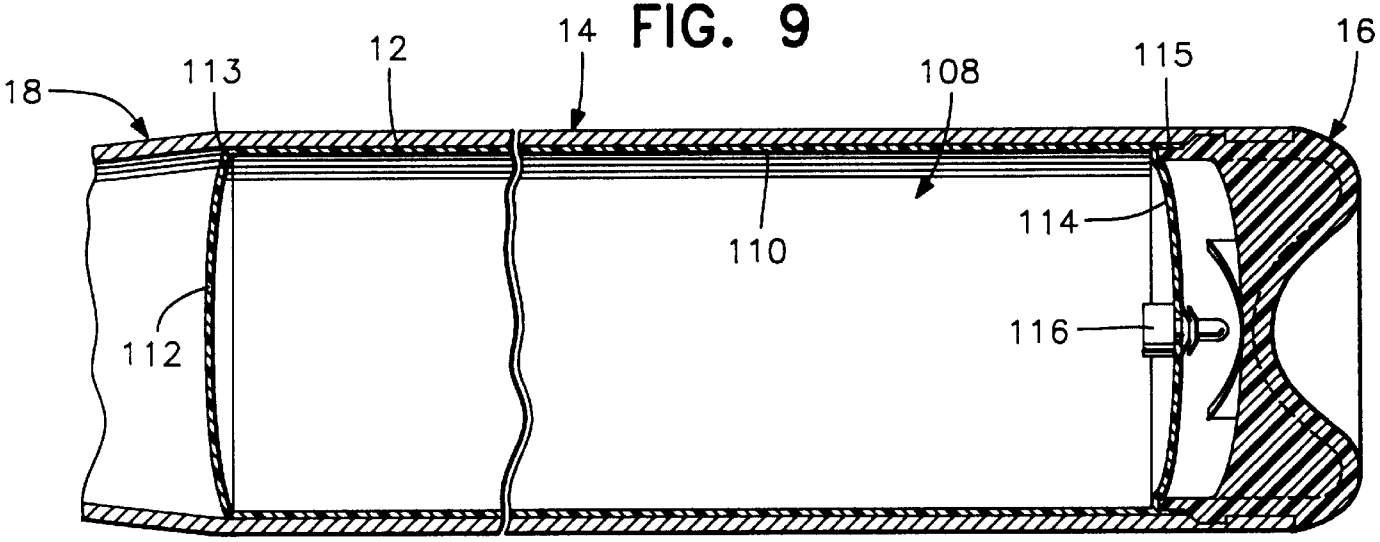
FIG. 9 is a sectional view similar to FIG. 2 of a further embodiment of the present invention, in which the transverse wall has been omitted and the inflated bladder is held in place by the pressurized frictional engagement of the bladder wall and the inside of the bat barrel.

FIG. 9 illustrates another embodiment of the present invention with bat barrel 12 having hitting zone 14, end cap 16 and transition zone 18. In this embodiment of the invention, the transverse wall at the juncture between the hitting zone and transition zone is omitted. A generally tubular bladder 108 with cylindrical side wall 110 is inserted into the bat barrel 12 in the area of the hitting zone 14 with the proximal end 112 engaging the narrowed bat barrel at the distal end 113 of the transition zone 18. The distal end 114 of the bladder 110 is engaged by the end cap 16 to secure circumference flange 115 of distal end 114 of the bladder 110 in position. The distal end 114 of the bladder 110 is provided with a self sealing valve 116. The valve 116 enables inflation and pressurization of the interior of the bladder 110 by the use of an inflation needle connected to a pump or other source of air pressure after the bladder has been positioned in the bat barrel 12 and prior to the end cap 16 being inserted into the barrel distal end. The passageway through the valve 116 permits entry of the inflation needle to enable inflation, and the valve will self seal when the inflation needle is withdrawn. Upon inflation and pressurization of the bladder 108, the cylindrical wall 110 of the bladder 108 exerts an outward force on the inside of the bat barrel. As additional air is pumped into the bladder 108, the end walls 112 and 114, which are normally perpendicular to the cylindrical wall 110 when bladder 108 is uninflated, are forced outwardly into a generally radius configuration, as shown in FIG. 9.

Figure 10:
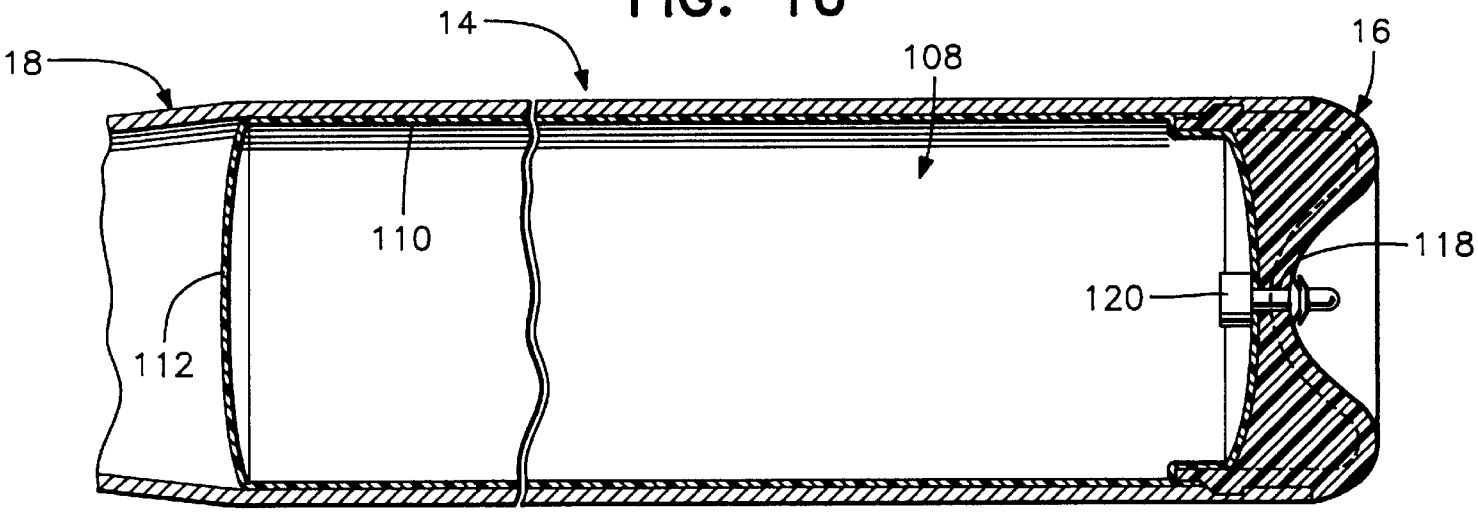
FIG. 10 is a sectional view similar to FIG. 9 of yet another embodiment of the present invention in which an inflation valve extends through the end cap for altering the pressurization of the bladder from outside the bat.

FIG. 10 illustrates an arrangement similar to FIG. 9 except that the end cap 16 is provided with an opening or hole 118 through which inflation valve 120 extends generally flush with the outer surface of the end cap 16. This configuration thus enables an inflation needle to be inserted through the valve 120 and through the end cap 16 into bladder 108 after the end cap has been installed. This enables the pressure in the bladder to be varied by individual users after the insertion of the end cap and final manufacture of the bat.

Figure 11:
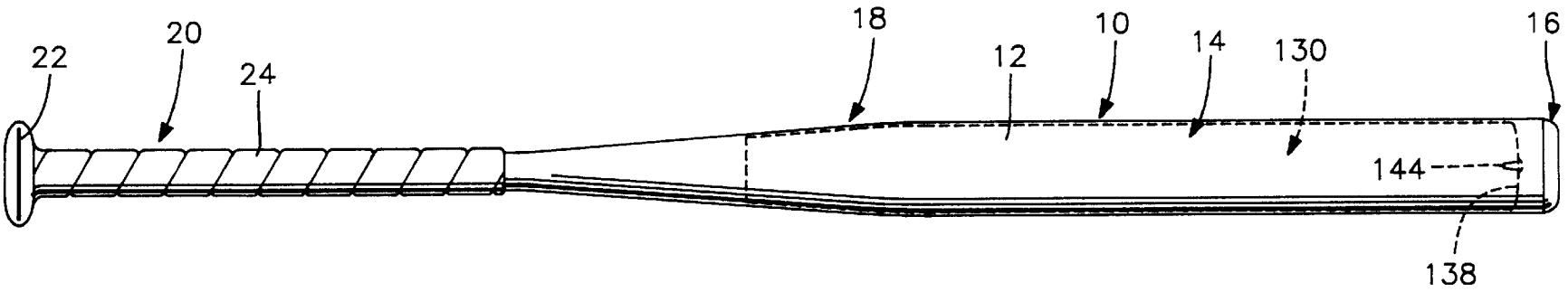
FIG. 11 is a side elevational view of a still further embodiment of a hollow metal bat in accordance with the present invention, with a single pressurized bladder tapered at its proximal end in order to engage the distal end of the transition zone of the bat when the bladder is inflated so as to lock the bladder in position in the area of the hitting zone.
Figure 12:
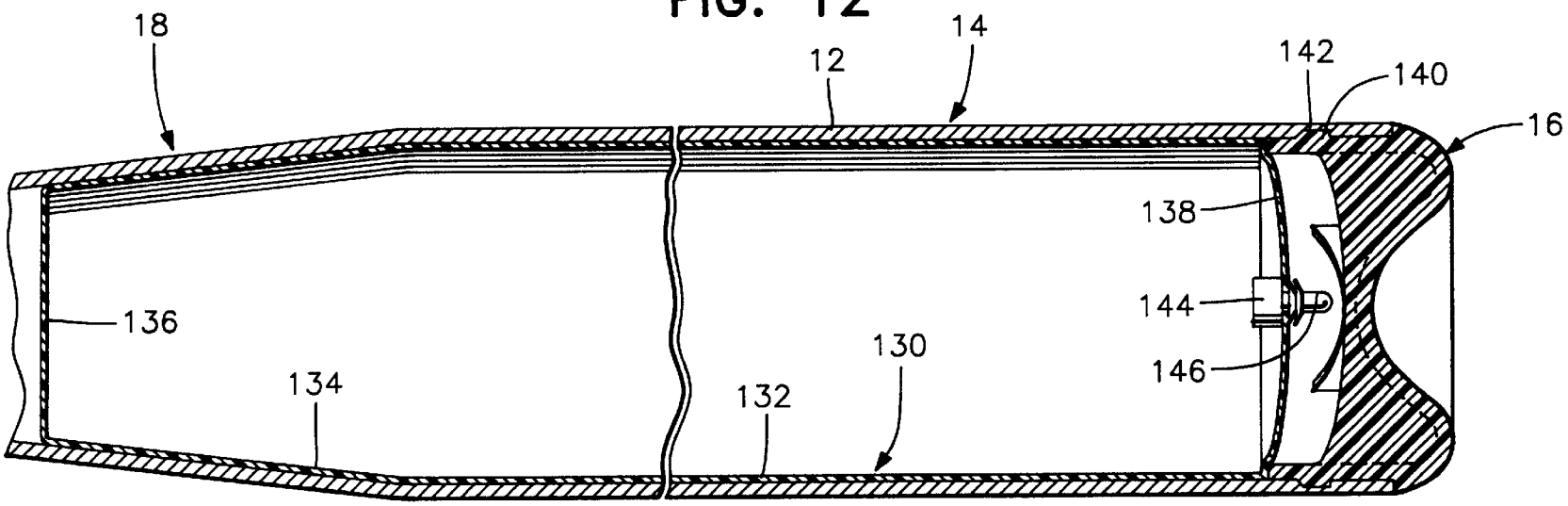
FIG. 12 is a longitudinal sectional view, on an enlarged scale, of the embodiment of the invention illustrated in FIG. 11, illustrating the engagement of the bladder with the interior of the bat barrel in both the transition zone and hitting zone.

FIGS. 11 and 12 illustrate still another embodiment of the present invention in which the bat 10 includes a hollow bat barrel 12 with a hitting zone 14 having an end cap 16 at the distal end thereof and a tapered transition zone 18 at the proximal end thereof. The tapered transition zone 18 extends into a handle 20 having a knob 22 at the proximal end thereof and grip enhancing material 24 on the handle 20. This bat structure is substantially the same as that disclosed in the previous embodiments of the invention with the hitting zone 14 and the transition zone 18 dimensionally varying to adapt the bat for use as a baseball bat or as a softball bat including the numerous models for each.

Positioned interiorly of the bat barrel is a bladder generally designated by reference numeral 130 which includes a generally cylindrical peripheral wall 132 having a tapered proximal end 134 extending into the transition zone 18 as illustrated in FIG. 12. The cylindrical peripheral wall 132 and the tapered wall 134 are preferably constructed of a resilient flexible material having a diameter approximating the internal diameter of the bat barrel 12 and the transition zone 18. The proximal end of the bladder 130 is closed by an end wall 136 that forms a closure for the proximal end of the bladder and extends generally transverse of the transition zone 18 in spaced relation to the proximal end of the hitting zone 14. The distal end of the bladder 130 is closed by a circular end wall 138 that, when inflated, is generally convex on its outer surface and concave on its inner surface as illustrated in FIG. 12. The end wall 138 is connected to the distal end of the cylindrical wall 132 by heat sealing or frequency welding in a known manner. The end cap 16 is secured in place by a ridge 140 and groove arrangement 142 similar to that disclosed in the embodiments of the invention illustrated in FIGS. 1–10.

In order to inflate the bladder 130, the distal end wall 138 is provided with a self sealing valve 144 capable of receiving an inflation needle which can be withdrawn after the bladder has been inflated with the valve 144 sealing itself to maintain the inflation pressure in the bladder 130. The end cap 16 may then be placed in the distal end of the bat barrel 12. The bladder 130 may extend into the transition zone 18 for a distance ranging between about 1 inch up to as much as about 6 inches with the end wall 136 preferably being positioned approximately 2 to 3 inches into the transition zone 18.

The bladder 130 is inserted into the open end of the bat barrel 12 prior to being inflated with the end walls 136 and 138 being oriented longitudinally within the bat barrel 12 and transition zone 18. The bladder is then inflated with the flexible peripheral wall 132 being initially expanded into engagement with the internal surface of the bat barrel 12. The remainder of the bladder then will expand into surface-to-surface contact throughout the length of the bat barrel inwardly of the open end of the barrel and inwardly of the groove 140 adjacent the distal end of the bat barrel 12. With this construction, the tapered portion of the proximal end of the bladder 130 conforms with and engages the tapered internal surface of the transition zone to securely orient the bladder 130 in the desired position with the proximal transverse end wall 136 of the bladder 130 being oriented in the preferred relationship to the transition zone 18. As illustrated in FIG. 12, the valve 144 includes a projecting tip 146 extending axially from the valve 144 toward the end cap 16. The tip is constructed of a plastic material having a passageway therein for receiving the inflation needle. After inflation, the tip 146 of valve 144 can be seared to close off the air passageway, thus providing a double seal for the bladder 130 with the initial seal being the self sealing construction of the valve 144 itself and the second seal being the heat sealing by deformation of the plastic tip 146. This searing also prevents tampering with the pressurization of the bladder.

Figure 13:
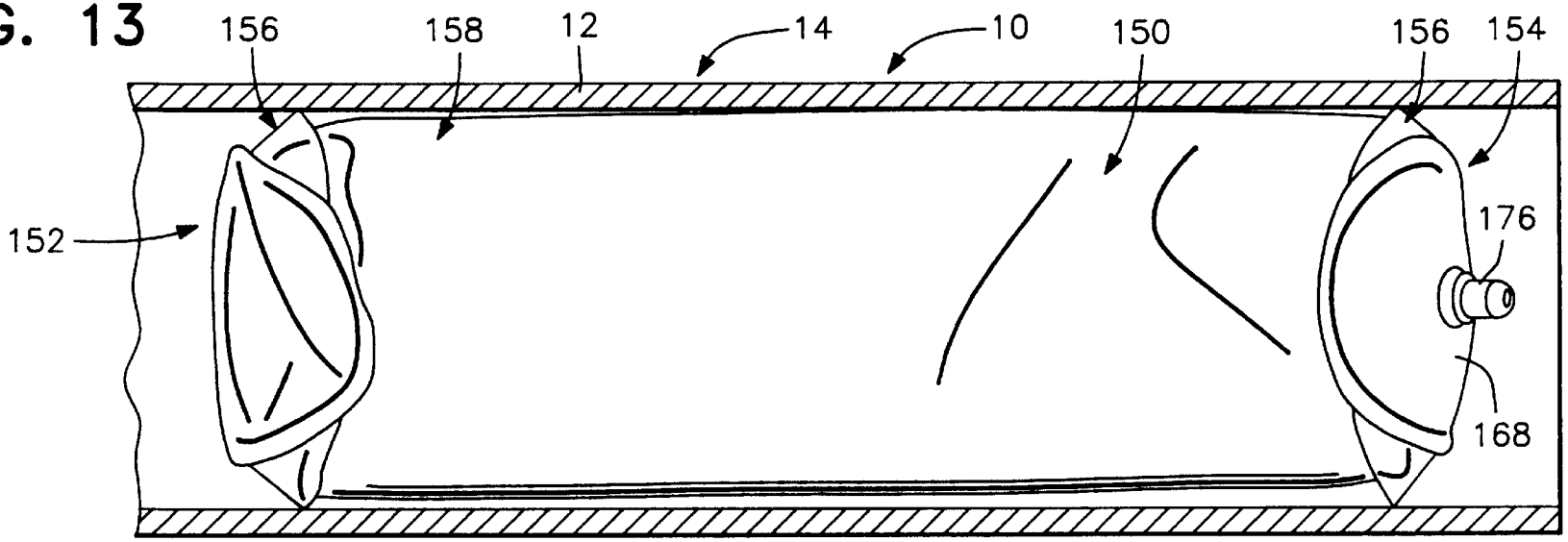
FIG. 13 is a partial sectional view of yet another embodiment of the present invention, illustrating a single bladder in a relaxed, uninflated state positioned within the bat barrel in the area of the hitting zone.
Figure 14:
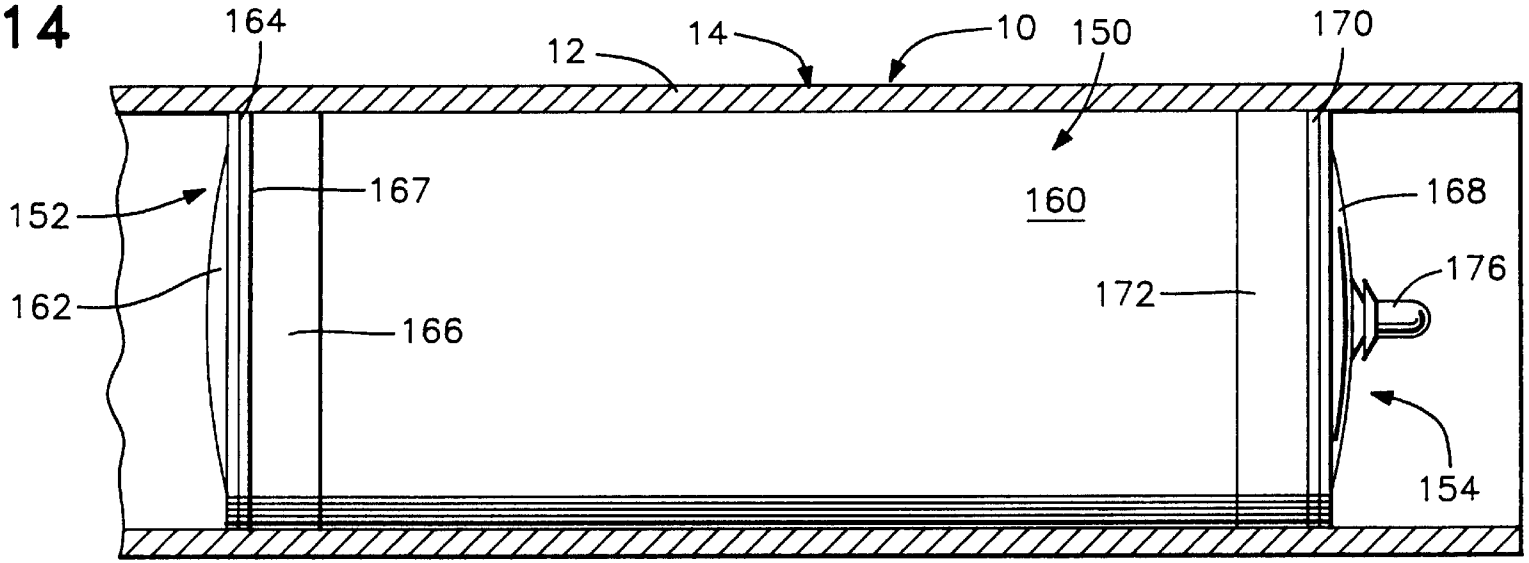
FIG. 14 is a partial sectional view of the embodiment of the present invention shown in FIG. 13, illustrating the bladder fully inflated with the bladder cylindrical wall exerting pressure on the inside of the bat barrel in the area of the hitting zone.
Figure 15:
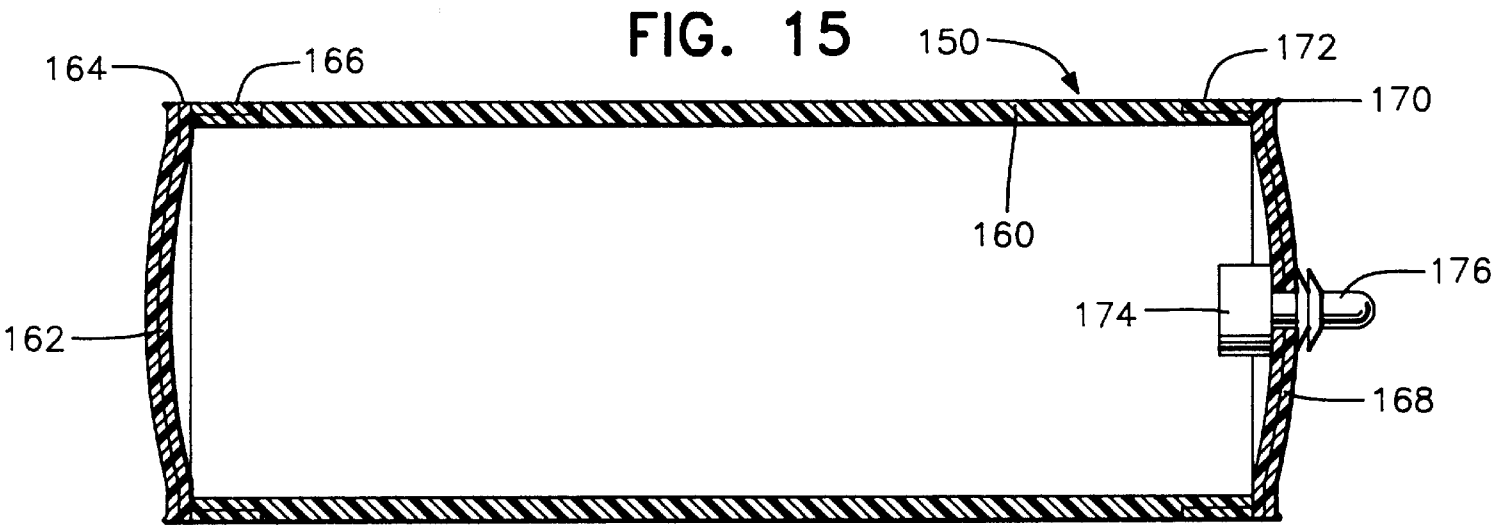
FIG. 15 is a longitudinal sectional view taken along the center of the bladder of FIG. 14, illustrating the structural details of the bladder when inflated inside the bat barrel in the area of the hitting zone.

FIGS. 13–15 illustrate yet another embodiment of the bat of the present invention in which the bat 10 is the same as that disclosed in the previous embodiments and includes a bat barrel 12 including a hitting zone 14. An inflatable bladder 150 is inserted into the open distal end of the bat barrel 12 and is inserted into the bat barrel 12 before it is inflated. The bladder 150, when uninflated is substantially flat throughout its extent except for the proximal and distal ends as illustrated in FIG. 13. The proximal end of the bladder 150 before it is inflated is indicated generally by reference numeral 152, and the distal end is designated generally by numeral 154. Each of the ends 152 and 154 include opposed edges 156 which extend beyond the opposed edges 158 of the uninflated bladder 150 as illustrated in FIG. 13. This construction provides a frictional engagement of the diametrically opposed projecting portions 156 of the end walls 152 and 154 with the internal surface of the bat barrel 12 to position the uninflated bladder 150 within the hitting zone 14 until the bladder 150 has been inflated. When the bladder 150 is inflated, the central portion of the peripheral wall 160 of the bladder will expand first into engagement with the internal surface of the bat barrel 12 as illustrated in FIG. 13 so that the frictional engagement between the central portion of the peripheral wall 160 of the bladder 150 will then hold the bladder 150 in position during final inflation.

As illustrated in FIGS. 14 and 15, the end wall 152 includes two or three circular panels 162 which are heat sealed or welded together in any conventional manner and include a peripheral edge 164 extending slightly beyond the cylindrical wall 160. Additional layers of material are preferred for the end panels in order to provide additional strength to the ends of the bladder 150. Also, a skirt 166 of cylindrical configuration extends longitudinally along the external surface of the cylindrical peripheral wall 160 with the cylindrical skirt 166 being free of the cylindrical wall 160 but integrally joined with the end wall panels 162. The cylindrical skirt 166 forms a reinforcement for both the end portion of the cylindrical peripheral wall 160 and the seam 167 formed by heat or the like between the end panels 162 and ends of wall 160 and skirt 166, as illustrated in FIG. 14 and 15.

The end wall 154 is of the same construction as the end wall 152 and preferably includes two or three panels 168 with peripheral flanges 170 having a longitudinally extending skirt 172 seamed together to provide a generally cylindrical bladder 150 which, when inflated, will securely engage the internal surface of the bat barrel 12 in the hitting zone 14. The bladder 150 is thus locked in place by engagement with the bat barrel and end wall 154 can be spaced from the end cap closing the open distal end of the bat barrel 12. The end wall 154 includes a self sealing valve 174 extending through the panels 168 and a projecting tip 176 on the external surface of the end wall 154 constructed of a plastic material and having a passageway therethrough for receiving the inflation needle. The tip 176 can be deformed and sealed by application of heat and pressure to provide a second security seal for the bladder in addition to the self sealing valve 174.

Figure 16:
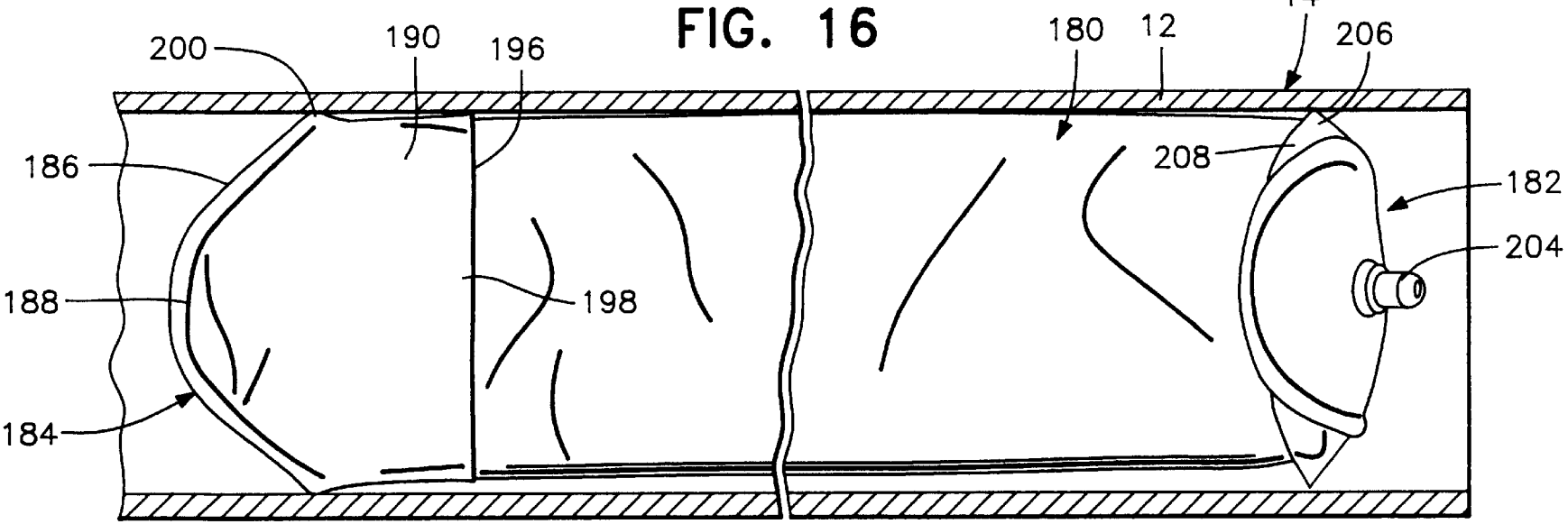
FIG. 16 is a partial sectional view of still another embodiment of the present invention, illustrating a single bladder in a relaxed, uninflated state positioned within the bat barrel in the area of the hitting zone.
Figure 17:
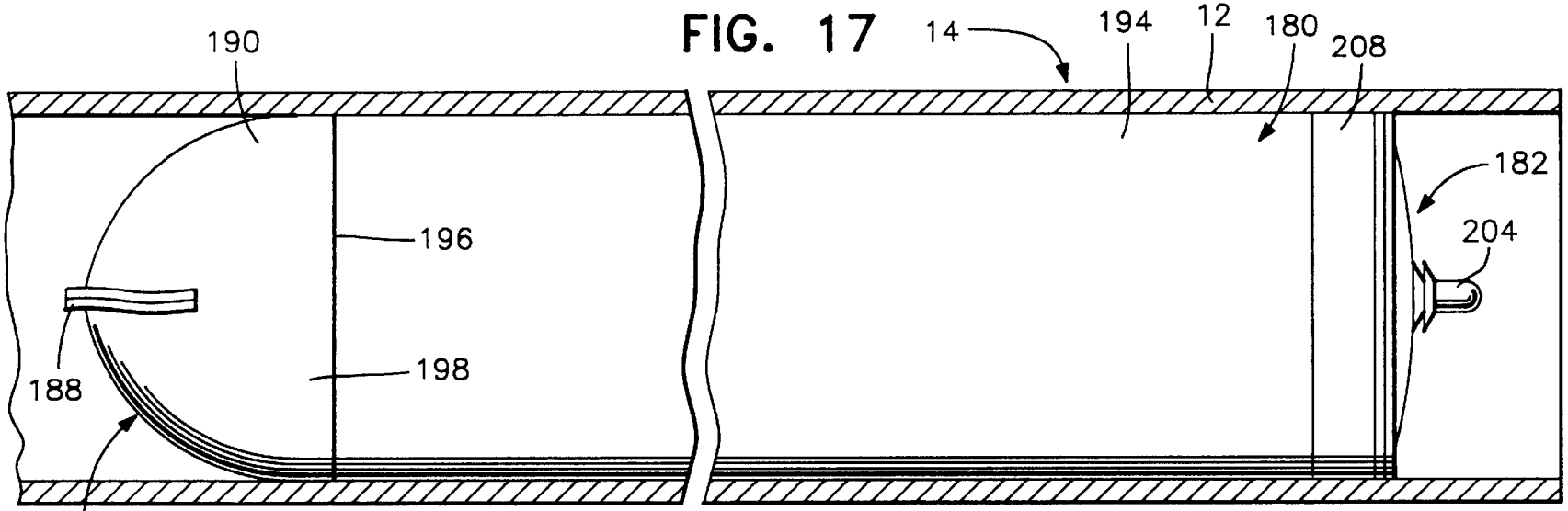
FIG. 17 is a partial sectional view of the embodiment of the present invention shown in FIG. 16, illustrating the bladder fully inflated with the bladder cylindrical wall exerting pressure on the inside of the bat barrel in the area of the hitting zone.
Figure 18:
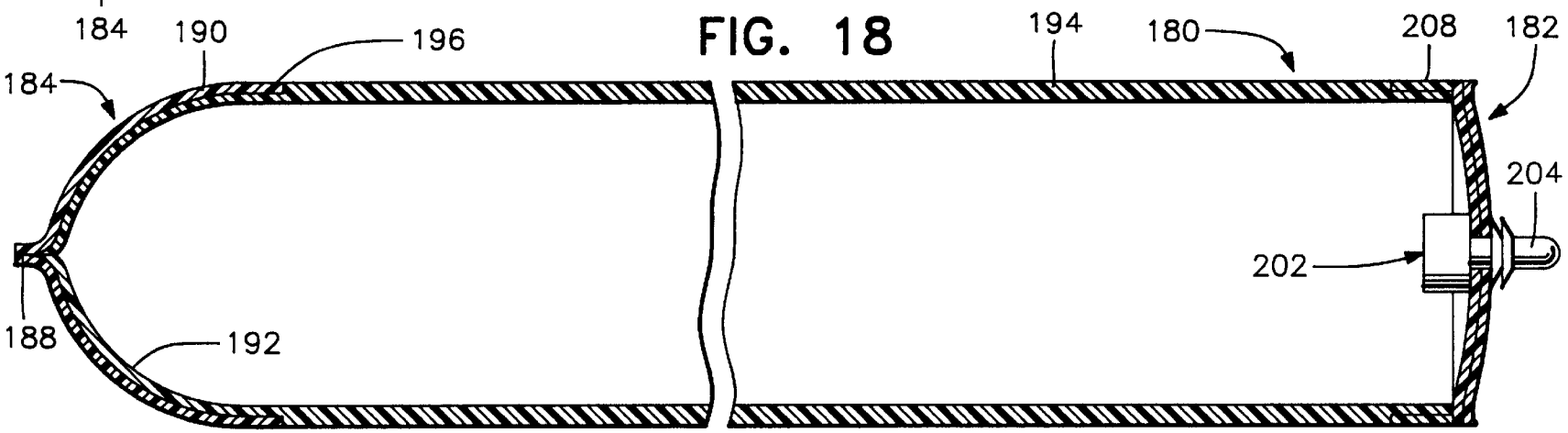
FIG. 18 is a longitudinal sectional view taken along the center of the bladder of FIG. 17, illustrating the structural details of the bladder when inflated inside the bat barrel in the area of the hitting zone.

FIGS. 16–18 illustrate still a further embodiment of the present invention in which bladder 180 is inserted into a bat barrel 12 within the hitting zone 14 in which the distal end of the bladder generally designated by reference numeral 182 is the same as the distal end 154 disclosed in the embodiment illustrated in FIGS. 13–15. The proximal end of the bladder 180 is generally designated by reference numeral 184 and includes a generally semicircular end edge 186 provided with a peripheral seam 188. The seam 188 forms a closure for the proximal end 184 of the bladder 180 with an extended skirt 190 overlying, but being free of, corresponding inwardly curved portions 192 of the peripheral wall 194 of the bladder 180. The skirt 190 includes a distal end edge 196 which extends circumferentially around the cylindrical portion of the peripheral wall 194 when inflated. The proximal edge of the skirt 190 is incorporated into the seam 188 for additional reinforcement in forming the seal 188. As illustrated in FIG. 16, the generally semicircular edge 186 joins with a continuous skirt of generally cylindrical configuration as indicated by reference numeral 198 which extends to the terminal end edge 196 of the skirt.

As illustrated in FIG. 16, the end edges of the semicylindrical edge of the skirt 190 project slightly beyond the deflated extremities of the bladder 180 and the cylindrical portion 198 of the skirt 190 thus frictionally engaging the internal surface of the bat barrel as indicated by reference numeral 200 in FIG. 16 when the bladder 180 is uninflated. When the bladder is inflated, the central portion of the peripheral wall 194 will initially engage the internal surface of the bat barrel 12 to hold the bladder 180 in position and final inflation of the bladder 180 forms the skirt 190 into the configuration illustrated in FIGS. 17 and 18. Also, the end wall structure 182 is formed into the configuration illustrated in FIG. 18 with the valve assembly 202 therein being the same as the valve assembly in FIGS. 13–15 with the tip 204 preferably deformed and sealed to provide a secondary seal for the bladder 180. The end wall 182 when uninflated as illustrated in FIG. 16, the diametrically opposed projecting portions 206 of the skirt 208 will engage the internal surface of the bat barrel 12 to assist in securing the bladder 180 in position prior to inflation. Once fully inflated, bladder 180 is locked in place in barrel 12 and end wall 182 can be spaced inwardly of the end cap.

Figure 19:
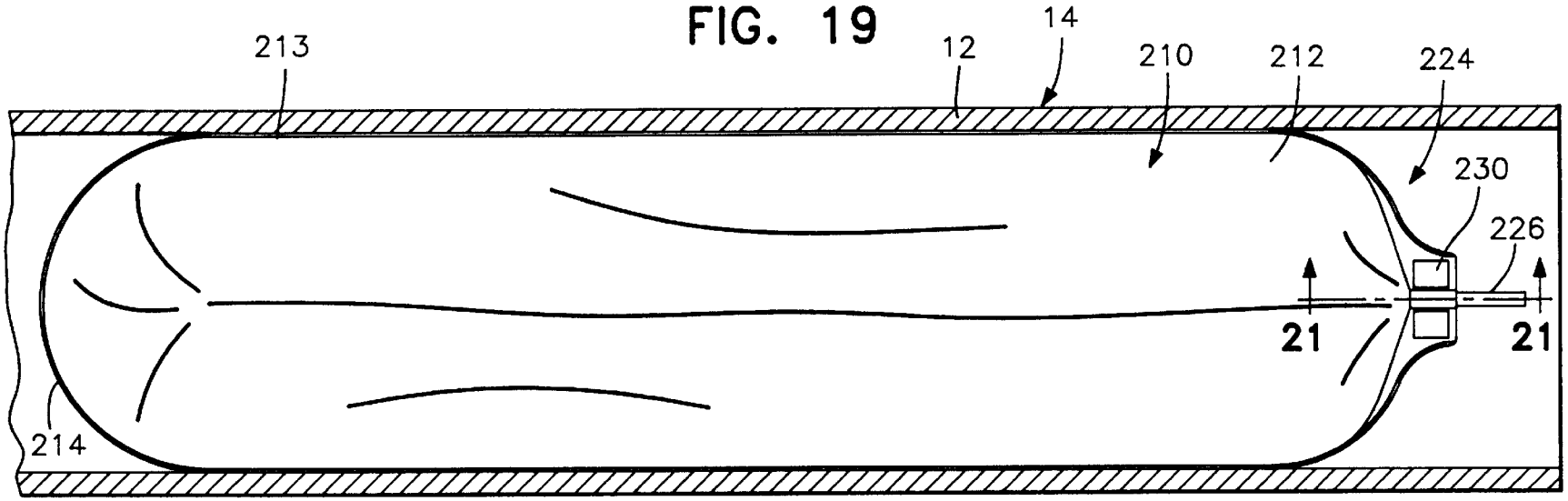
FIG. 19 is a partial sectional view of still yet another embodiment of the present invention, illustrating a single bladder in a relaxed, uninflated state positioned within the bat barrel in the area of the hitting zone.
Figure 20:
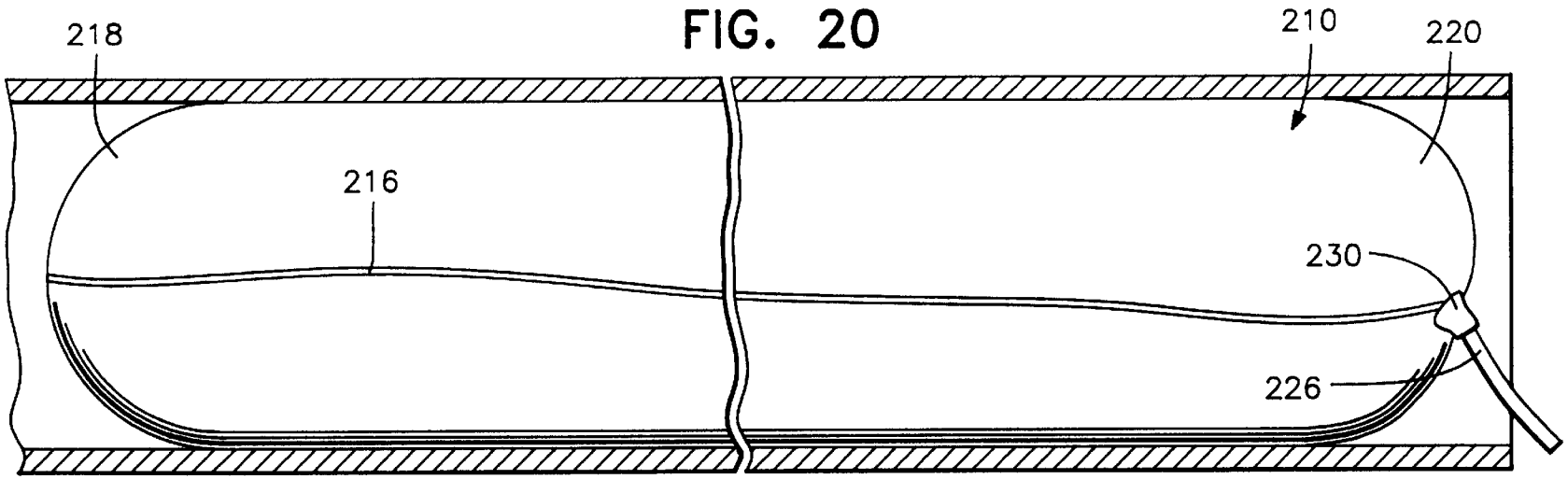
FIG. 20 is a partial sectional view of the embodiment of the present invention shown in FIG. 19, illustrating the bladder fully inflated with the bladder cylindrical wall exerting pressure on the inside of the bat barrel in the area of the hitting zone.
Figure 21:
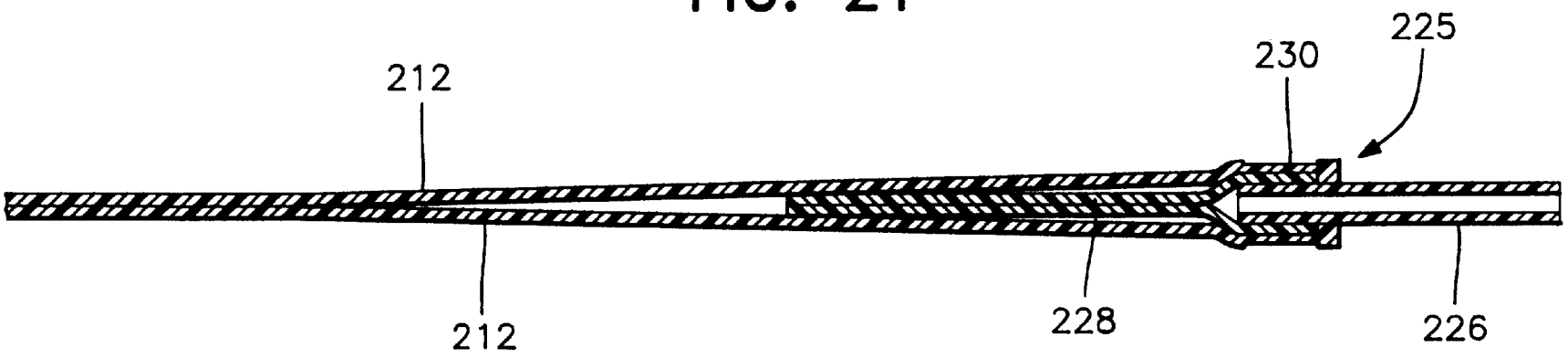
FIG. 21 is a sectional view taken along section line 21—21 on FIG. 20, illustrating the structural details of the bladder valve assembly and the bladder when uninflated.

FIGS. 19–21 illustrate a final embodiment of a bladder to be specifically disclosed herein. The bladder is generally designated by reference numeral 210 which is positioned in the bat barrel 12 from the distal end thereof along a predetermined length of the hitting zone 14. As illustrated, the bladder 210 when uninflated includes a pair of identical, flat panels 212 made from thin sheet or film material. Each panel 212 has parallel side edges 213 and semicircular end edges 214 which are seamed together around the periphery thereof by heat sealing or frequency welding or other conventional sealing connection, as at 216. When inflated, the two ends 214 of the bladder 210 become substantially semispherical as indicated at 218 and 220 with the seam 216 extending around the entire longitudinal periphery at diametrically opposed edged of the two panels 212. If desired, each panel 212 could include more than one layer of sheet or film material, such as a double panel, or each end 214 could have a separate reinforcing layer similar to the skirt described for embodiments illustrated in FIGS. 13–18. Alternatively, each end 214 could be reinforced by one or more layers which cover substantially all of the semispherical end including the central seam.

The distal end 224 of the bladder 210 includes a pressure sealing valve assembly generally designated by the number 225. The valve assembly 225 includes a central tube 226 which extends through the seam 216 in the end edge 220 and a flat flexible tube 228 surrounding and joined to the inner end of the tube 226 in a manner to receive pressured air therethrough. However, the walls of the flat tube 228 are substantially more flexible than the tube 226 so that air pressure within the interior of the inflated bladder 210 will maintain the flat tube 228 in a closed and sealed condition when there is no higher pressure forcing air into the bladder 210 through tube 226. Tubes 226 and 228 are preferably made of suitable known plastic materials.

As illustrated, the sealed end edge 216 at the distal end 224 includes a flattened axial projection 230 that effectively seals end 224 around the inflation tube 226. Thus, the tube 226 constructed of a plastic material can be heated and deformed or otherwise sealed to form a second seal in addition to the seal formed by the highly flexible flat tube 228 thereby securing the air pressure within the bladder 210.

This construction enables the bladder to be constructed of flat panels 212 with the side edges 213 engaging the internal surface of the bat barrel 12 when uninflated as illustrated in FIG. 19, thus maintaining the bladder in place while uninflated. As the bladder is inflated, the central portion of the panels 212, being more flexible, will expand first into engagement with the internal surface of the bat barrel 12 thus securing the bladder in position during final inflation. After inflation, withdrawal of the inflation needle or other inflation device connected with the tube 226 enables the flexible flat tube 228 to be retained in flat condition with the opposed walls thereof in surface-to-surface engagement to form a seal between the flat tube walls. Once fully inflated, bladder 210 is also locked in place in bat barrel 12. A secondary seal is preferably formed by heat sealing or otherwise sealing and deforming the tube 226 thereby providing a bladder which is effective in exerting an internal force against the internal surface of the hitting zone in which the bladder is constructed of flat material sealed around the peripheral edges thereof thereby simplifying the manufacture as well as installation of the bladder.

The pressurization level of the bladders described above is similar to that previously described in connection with bladder 28. More specifically, the bladders may be pressurized in accordance with the present invention with as little as near zero pressure and as high as 60 psi, or even higher for special constructions. Normally, the pressurization should range between about 15 psi to about 50 psi and, preferably, between about 20 psi and about 30 psi. Further, any appropriate fluid can be used to pressurize the bladders in accordance with the present invention, although air has been referred to in describing the invention. For example, gases such a nitrogen, argon and other large molecule gases can be used instead of air, and perhaps suitable lightweight liquids. Presently, air and argon are the preferred pressurizing fluids.

Each bladder may have single cells or compartments or multiple cells or compartments. It is believed that the bladders may be constructed of any suitable material including resilient flexible materials or semirigid materials, made from neoprene, polyvinylcloride (vinyl), polyurethene esters, polyurethene ethers, olefins, polyesters, polyethylterephthlate, elastomers, polyethylene, polypropylene and other suitable plastics and the like, or even substantially rigid materials such as rigid plastic, metal or composite materials. Of these three different types of materials for construction of the bladder or bladders, a resilient flexible material is most preferred and substantially rigid material is least preferred. By way of example, the bladder 28 of the embodiment illustrated in FIGS. 1–4 and the body of the bladders 76 of the embodiment illustrated in FIGS. 5–8 have been constructed of a semirigid plastic material. The bladders 150 and 180 illustrated in the embodiments of FIGS. 13–15 and 16–18, respectively, have been constructed of a resilient flexible material. Finally, the bladder 210 of the embodiment illustrated in FIGS. 19–21 was constructed of a resilient flexible thin sheet or film, specifically polyurethane ester thin sheet.

The thickness of the thin sheet or film material from which the bladder is preferably constructed can vary from material to material, depending upon the strength, toughness and life characteristics of the particular material. Typically, appropriate materials having a thickness in the range of 15 mils can be used. In view of the desirability of reducing the weight of the bat in the area of the hitting zone, and moving the center of gravity of the bat towards the handle, economical materials having high weight to strength ratios are preferred, consistent with the necessary toughness and long life required for use in a metal bat. It is contemplated that all of the bladder constructions disclosed in the instant application can be formed by the materials described herein.

Where the bladder is made from a resilient flexible material, the diameter of the generally cylindrical peripheral wall, such as peripheral wall 160 in the FIGS. 13–15 embodiment, can be slightly larger than the internal diameter of the peripheral wall of the bat barrel in the area of the hitting zone so as to provide engagement between the bladder and the surface of the wall when positioning the bladder prior to inflation. Further, this arrangement would allow for variations in the internal diameter of the hitting zone wall. This feature can be important in bat models where the hitting zone is not uniform throughout its length, but tapers inwardly toward the distal end. In this type bat model, it is desirable that the bladder wall be sized and sufficiently flexible so that it can readily expand into full pressure contact with the length of the bat barrel interior to be pressurized.

In circumstances where a semirigid material is used for the bladder, it may be preferable to size the diameter of the generally cylindrical peripheral wall slightly less than the internal diameter of the barrel wall so as to permit easy insertion of the bladder into the bat barrel and have the peripheral wall expand into surface-to-surface contact with the interior surface of the wall upon inflation or pressurization of the bladder. Where a rigid material is used for the bladder structure, the generally cylindrical peripheral wall should have an outside diameter designed to be the same as the internal diameter of the peripheral wall so that as close to a surface-to-surface contact with the interior surface of the wall can be achieved. The peripheral wall of the bladder then serves as a reinforcement for the bat wall.

It may also be possible in accordance with the present invention for the bladder component to be constructed in various forms. While a generally cylindrical tubular bladder is preferred, it will be obvious to those skilled in the art that any elongated, or other, shape can be constructed, especially using the flat sheet technology disclosed in connection with the embodiment illustrated in FIGS. 19–21. Further, any number of bladders or bladder chambers can be designed to apply the requisite internal pressure to the bat barrel wall in the area of the hitting zone. For example, plastic bubble type cushioning material that is forced into the hitting zone so that the peripheral surfaces of the bubbles engage the inner surface of the wall of the hitting zone and engage each other could be used. By partially compressing the bubbles as the bubble cushioning material is forced into the bat barrel in the area of the hitting zone, an outward force is exerted on the hitting zone wall.

As described previously, pressurized bladders installed in metal bat barrels in the area of the hitting zone in accordance with the present invention permit the wall thickness of the bat barrel to be reduced on the order 0.005 to 0.030 inches, and perhaps even more in metal bats having thicker initial barrel wall thicknesses. The thinning of the barrel wall thickness is preferably throughout the length of the bat barrel, but can be confined to the area of the hitting zone. Further, metal material could be removed from the interior of the bat barrel in the hitting zone other than by thinning the entire thickness of the bat wall, such as by grooving the interior of the bat barrel in the area of the hitting zone. In such circumstances, it may be desirable to encase the bladder with a high strength film so as to prevent the interior grooving from damaging the bladder during bat use.

The pressurized bladder or bladders in accordance with the present invention are confined within the interior surface of the peripheral wall of the hollow bat barrel in the area of the hitting zone thereby exerting outward pressure on the interior surface of the hitting zone peripheral wall. This force pressurizes the peripheral wall of the hitting zone thereby reinforcing and stiffening the peripheral wall. As previously described, the bladder reinforcement and stiffening of the bat barrel in the area of the hitting zone enables the peripheral wall of the hitting zone to be constructed of a thinner material thereby reducing the overall weight of the barrel and particularly the hitting zone so that the bat speed can be increased by exerting normal hitting force on the bat handle. This also enables the hitting zone to contact a ball with a greater velocity thereby increasing the exit velocity of the ball. Further, pressurization of the wall of the hitting zone allows regulation and equalization of the trampoline effect by rigidifying the hitting zone wall so that it will return back to its normal position when deformed by striking a ball at a higher rate of return to normal shape thereby increasing the force exerted on the ball. Additionally, utilization of a bladder in the area of the hitting zone of a metal bat significantly reduces the level of vibration transmitted to the bat handle and improves the bat sound upon impact with the ball.

While the pressurized bladder or bladders in accordance with the present invention preferably extend substantially the full longitudinal length of the bat barrel in the area of the hitting zone, the bladder or bladders may extend less than the full length of the hitting zone and still achieve the benefits available from the present invention, at least for that portion of the hitting zone in which the bladder or bladders provided surface-to-surface contact with the inner wall of the bat barrel and provide an outward force thereon. For example, bladders in accordance with the present invention have been constructed for different bat models, both baseball and softball, as short as about 4 inches and as long as 20 inches. For most models, a bladder or bladders which extend a distance of about 8 to about 15 inches on center in the hitting zone should be satisfactory. Preferably, the bladder or bladders should extend at least a major portion of the length of the hitting zone of the particular bat model.

Figure 3:
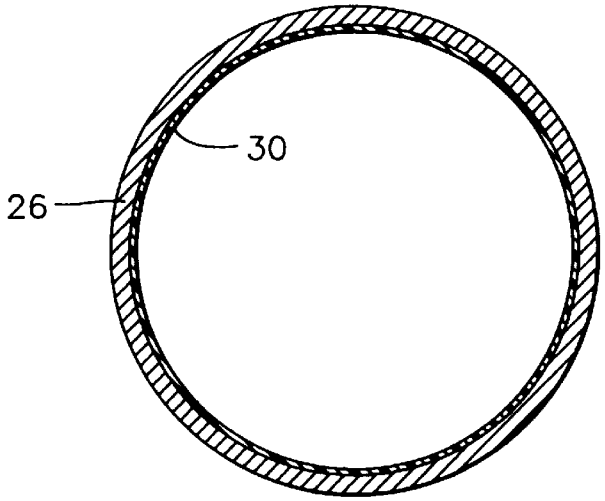
FIG. 3 is a transverse sectional view taken along section line 3—3 on FIG. 2 illustrating the intimate contact of the bladder wall with the interior of the bat hitting zone.
Figure 4:
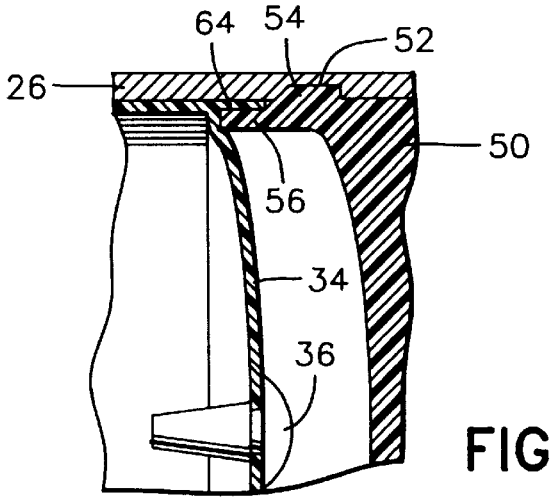
FIG. 4 is an enlarged fragmental sectional view of the embodiment of FIG. 2, illustrating the end cap at the distal end of the hitting zone including its relationship to a closure structure on the distal end of the bladder.

While the end caps illustrated in the drawings generally correspond to that disclosed in FIGS. 1–3 of copending application Ser. No. 06/396,225 filed Feb. 28, 1995, those skilled in the art will readily appreciate that any suitable end cap can be utilized in accordance with the present invention, including end caps with hardenable or weighted material to lock the end cap into the bat barrel and/or increase the bat distal end weight. For example, the bat distal end can be curled over with a closure cap as illustrated in FIG. 6 of the aforesaid application. After the bladder has been inserted into the bat barrel and inflated, hardenable material is introduced into the barrel through the opening and the closure cap is positioned in place. The bat is then turned upright (with the distal end down), and the hardenable material flows into the distal end where it hardens to lock the cap in place and provide additional weight.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A metal bat having a tubular barrel including a hitting zone at a distal end with a peripheral wall having an interior surface, a handle at a proximal end and a transition zone connecting the handle and hitting zone, and an inflated bladder fully contained within said metal bat, said bladder positioned in said hitting zone and exerting an outward force on said interior surface of the hitting zone peripheral wall, said bladder including a tube for inflating said bladder, said tube being permanently sealed after said bladder is inflated; where said bat has a hollow interior portion, said inflated bladder filling only a portion of said hollow interior portion.

2. The bat as defined in claim 1 wherein said bladder is cylindrical having a flexible and resilient peripheral wall in surface-to-surface contact with the interior surface of the peripheral wall of the hitting zone, and the distal end of said tubular barrel including an end cap, said end cap engaging a distal end of the bladder for anchoring the bladder longitudinally within the hitting zone.

3. The bat as defined in claim 1 wherein said bladder extends a substantial portion of said hitting zone and includes an end wall at a distal end thereof receiving said tube.

4. The bat as defined in claim 1 wherein said tube includes an inflation valve in an area aligned with the distal end of the bat barrel to enable pressurization of the bladder.

5. The bat as defined in claim 4 wherein said valve includes a self sealing passageway to enable inflation by an inflation needle with the passageway becoming sealed when the inflation needle is withdrawn.

6. A metal bat having a tubular barrel including a hitting zone at a distal end, a handle at a proximal end and a transition zone connecting the handle and hitting zone, said tubular barrel having a generally cylindrical peripheral wall with an interior surface in said hitting zone, and a pressurized bladder fully contained within said metal bat, and positioned in said hitting zone of said bat barrel engaging said interior surface to reinforce said peripheral wall, said bladder including a tube for inflating said bladder, said tube being permanently sealed after said bladder is inflated; where said bat has a hollow interior portion, said inflated bladder filling only a portion of said hollow interior portion.

7. The bat as defined in claim 6 wherein said pressurized bladder is pressurized by a fluid selected from air, nitrogen, argon or large molecule gas.

8. A metal bat having a hollow tubular barrel which includes a pressurized means in said barrel to exert an outward pressure on said barrel selectively in a hitting zone area of said bat, where said pressurized means comprises a bladder, said bladder including at least a pair of flat panels each having edges, said flat panels having a pressure sealing valve assembly inserted therebetween and extending outward therefrom, said edges being seamed together to form said bladder.

9. The metal bat of claim 8, where said pressure sealing valve assembly includes a central tube extending from an outer opening through said seamed edges and includes a flat tube joined to said central tube internal to said bladder, whereby, when a gas is inserted into said central tube outer opening and through said central tube and through said flat tube to pressurize said bladder, said gas is retained within said bladder by said flat tube being retained in a closed and a sealed condition so long as a bladder pressure has a value greater than a pressure in said central tube.

10. The metal bat of claim 9, whereby after said bladder has been pressurized with said gas, said central tube is sealed to provide an additional means for retaining said gas within said bladder.

11. The metal bat of claim 8, where said bladder directly engages said barrel.

12. The metal bat of claim 8, where said bladder is pressurized in the range of about 15 psi to about 50 psi.

13. The metal bat of claim 8, where said pressurized means has an elongated shape with generally spherical ends.

* * * * *